US009222211B2

(12) United States Patent
Ritchie, Jr.

(10) Patent No.: US 9,222,211 B2
(45) Date of Patent: Dec. 29, 2015

(54) MIXING CHAMBER CONNECTING SYSTEM IN A WASHING MACHINE

(71) Applicant: Group Dekko, Inc., Garrett, IN (US)

(72) Inventor: James A. Ritchie, Jr., Huntertown, IN (US)

(73) Assignee: Group Dekko, Inc., Garrett, IN (US)

( * ) Notice: Subject to any disclaimer, the term of this patent is extended or adjusted under 35 U.S.C. 154(b) by 231 days.

(21) Appl. No.: 13/941,831

(22) Filed: Jul. 15, 2013

(65) Prior Publication Data

US 2014/0014211 A1 Jan. 16, 2014

Related U.S. Application Data

(60) Provisional application No. 61/671,211, filed on Jul. 13, 2012.

(51) Int. Cl.
*D06F 39/08* (2006.01)

(52) U.S. Cl.
CPC ..... *D06F 39/088* (2013.01); *Y10T 137/9029* (2015.04)

(58) Field of Classification Search
CPC ..... D06F 39/088; Y10T 137/902
USPC ..... 137/315.01, 798, 313.12
See application file for complete search history.

(56) References Cited

U.S. PATENT DOCUMENTS

| | | | | |
|---|---|---|---|---|
| 6,085,780 | A * | 7/2000 | Morris | 137/377 |
| 6,546,951 | B1 * | 4/2003 | Armenia et al. | 137/312 |
| 6,550,292 | B1 * | 4/2003 | Southworth | 68/23.2 |
| 6,722,575 | B1 * | 4/2004 | Gagne et al. | 236/12.12 |
| 8,714,192 | B2 * | 5/2014 | Haltmayer et al. | 137/533 |

* cited by examiner

*Primary Examiner* — Kevin Lee
(74) *Attorney, Agent, or Firm* — Taylor IP, P.C.

(57) ABSTRACT

A water inlet system for a washing machine including a main body, at least one insert and a valve assembly. The main body is made of a first material. The at least one insert is spin welded to the main body. The at least one insert is made of a material substantially the same as the first material. The valve assembly is mechanically coupled and sealed with the insert. The valve assembly has a valve body made of a second material, with the first material and the second material being different.

14 Claims, 4 Drawing Sheets

MIXING CHAMBER CONNECTING SYSTEM IN A WASHING MACHINE

CROSS REFERENCE TO RELATED APPLICATIONS

This is a non-provisional application based upon U.S. provisional patent application Ser. No. 61/671,211, entitled "MIXING CHAMBER CONNECTING SYSTEM IN A WASHING MACHINE", filed Jul. 13, 2012, which is incorporated herein by reference.

BACKGROUND OF THE INVENTION

1. Field of the Invention

The present invention relates to fluidic connecting systems, and, more particularly, to connector devices and methods for fluid conveying systems in a washing machine.

2. Description of the Related Art

Water inlet devices are used to provide a mixing chamber and a vacuum break in the inlet water supply that disperses water from an inlet supply hose into the tub of a washing machine. The water is directed to a load of clothes, which are located in the bottom of the tub or along the sidewall of the tub.

The typical automatic clothes washer or dishwasher for home use is equipped to carry on a series of operations in sequence. The series of operation is most commonly referred to as a cycle. A typical cycle includes fill and rinse elements, each of which utilize a water inlet device, such as a mixing chamber and vacuum break, to supply water to the washer. A washing machine includes a housing in which the mechanical operating devices are mounted. It is typical to include a motor assembly for causing motion within the washing device and water control valves for turning on the hot and cold water as necessary under the control of a controller. The water control valves may be associated with the mixing chamber and water vacuum break The desirability of a vacuum break prevents water from re-entering the water supply source, thereby preventing the contamination of the water source. The mixing chamber allows the hot and cold water to be mixed prior to being discharged into the associated machine.

What is needed in the art is a simple cost effective way of connecting water control valves to a mixing chamber associated with a vacuum break.

SUMMARY OF THE INVENTION

The present invention provides an efficient connection system and method for the connection of water flow control valves to a mixing chamber for use with a washing machine.

The present invention in one form is directed to a water inlet system for a washing machine including a main body, at least one insert and a valve assembly. The main body is made of a first material. The at least one insert is spin welded to the main body. The at least one insert is made of a material substantially the same as the first material. The valve assembly is mechanically coupled and sealed with the insert. The valve assembly has a valve body made of a second material, with the first material and the second material being different.

The present invention in another form is directed to an insert system for use with a water inlet system of a washing machine. The water inlet system has a main body made of a first material and a valve assembly made of a second material. The insert system includes at least one insert spin welded to the main body. The at least one insert is made of a material substantially the same as the first material. The valve assembly is mechanically couplable and sealable to the insert, with the first material and the second material being different.

An advantage of the present invention is that it allows a valve with locking features to be mated to an insert of a different material, while the insert is cost effectively spun welded to a mixing chamber body.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
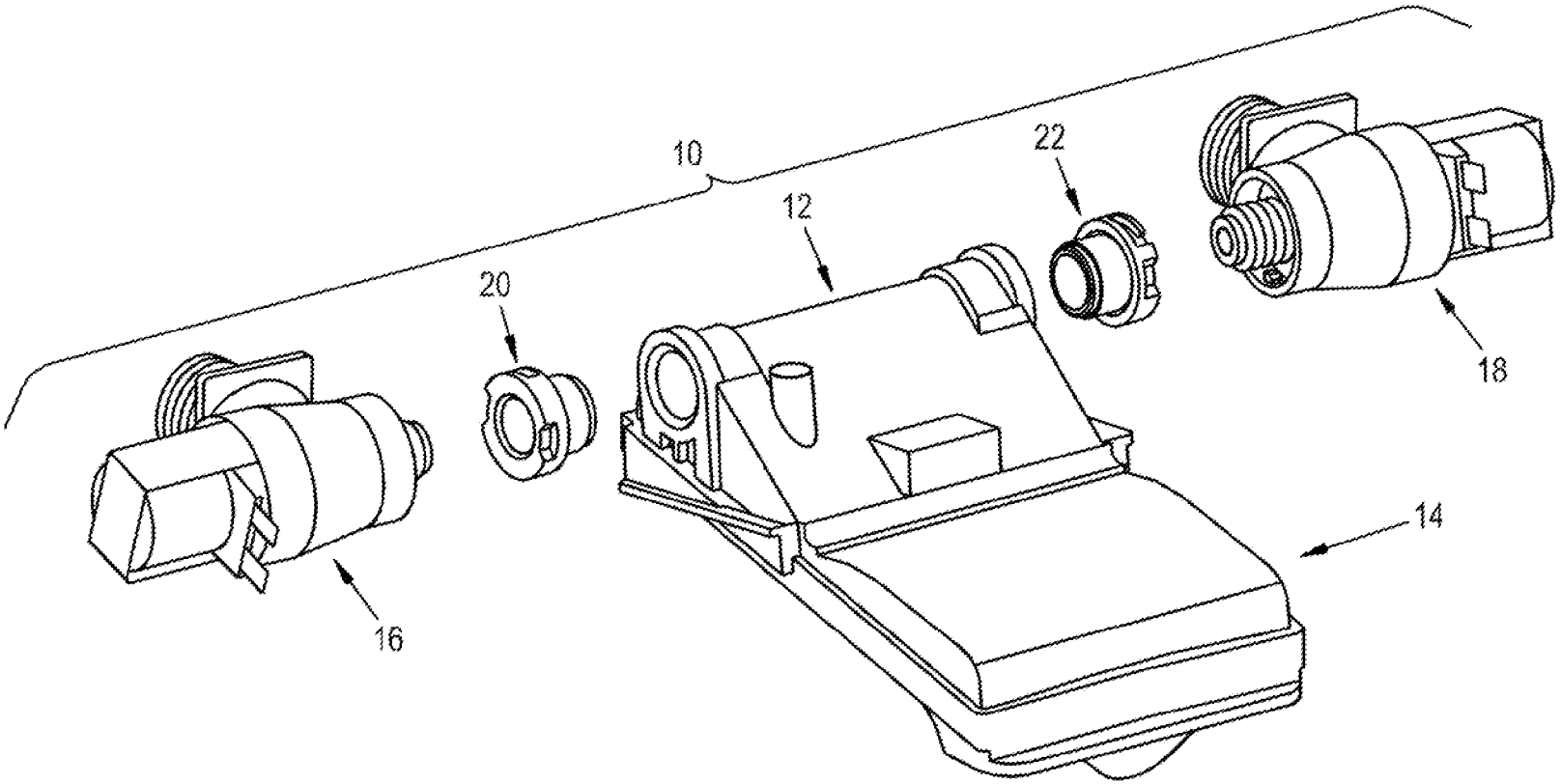
FIG. 1 is an exploded perspective view of an embodiment of a water inlet system of the present invention.

Referring now to the drawings, and more particularly, to FIG. 1, there is shown a water inlet system 10, which includes a mixing chamber 12 and a vacuum break 14 connected to mixing chamber 12, for use in a washing machine (not shown). Valves 16 and 18 are fluidically connected to mixing chamber 12 by way of inserts 20 and 22. Mixing chamber 12 is made of a material such as polypropylene (although it could be of other materials, such as polycarbonate) and the body of valves 16 and 18 are made of another material such as nylon. Since the body of valves 16, 18 are made of a material different than the material of mixing chamber 12 then valves 16 and 18 cannot be spun welded to mixing chamber 12. To overcome this problem inserts 20 and 22 are made from the same material (or substantially the same material) as mixing chamber 12 so that inserts 20 and 22 can be spin welded to mixing chamber 12. For example, the inserts 20, 22 are made of polypropylene; however, the inserts 20, 22 can be made of a thermoplastic polymer that is substantially similar to polypropylene so as to create a viable spin welded seal.

The latching details of inserts 20 and 22 can alternately be molded into mixing chamber 12. For example, the locking features of inserts 20 and 22 can be part of the mold that forms mixing chamber 12, thereby eliminating inserts 20 and 22. An advantage of spin welding inserts 20 and 22 to mixing chamber 12 is that it reduces the complexity of the molding of mixing chamber 12. The faces of inserts 20 and 22 are oriented in opposite directions as shown in the drawings, although other orientations are contemplated.

Figure 2:
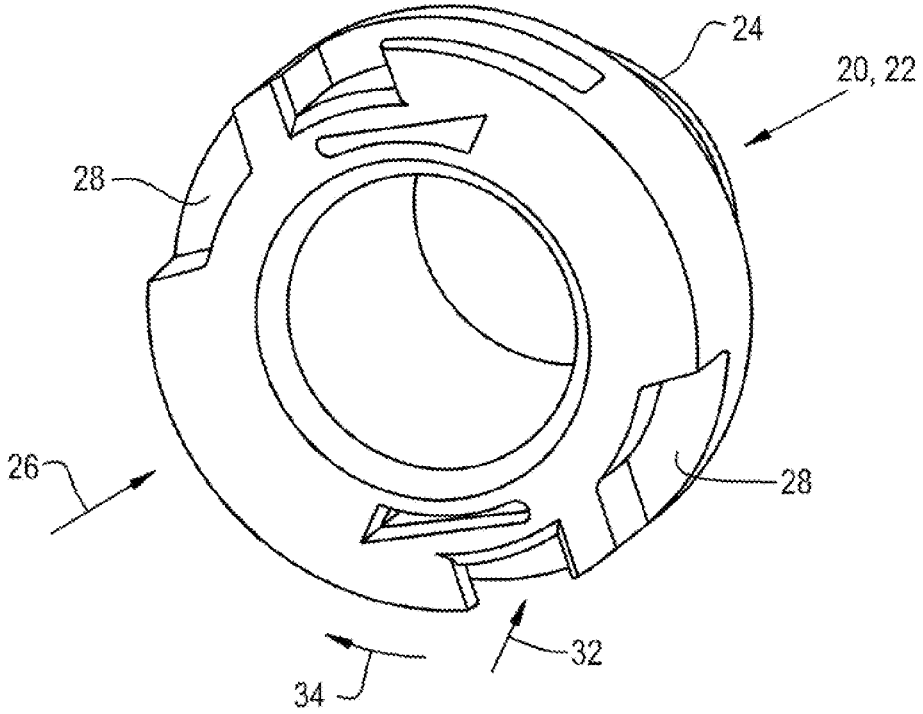
FIG. 2 is a perspective view of an embodiment of an insert used in the water inlet system of FIG. 1.
Figure 3:
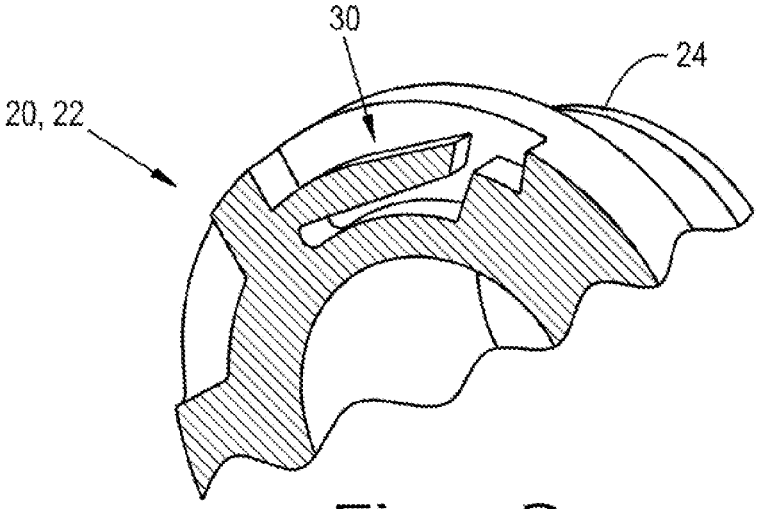
FIG. 3 is a partially sectioned view of the insert of FIG. 2.

Now, additionally referring to FIGS. 2 and 3, details of inserts 20 and 22 are illustrated. Inserts 20 and 22 may be identical, although it is also contemplated that they may be differently configured, to for example, preclude an inadvertent assembly of an incorrect part. Insert 20, 22 includes a substantially cylindrical contact surface 24, a spin weld interface 28 and a locking attribute 30. Surface 24 is brought into contact with and interior surface of mixing chamber 12, also known as main body 12 as inserts 20 and 22 are spun to cause the melting of the contacting materials together. The materials being either the same or substantially the same. It is contemplated that surface 24 may have a slight taper and that the corresponding receiving opening in main body 12 would have a corresponding taper. Spin weld interface 28 are two indents that allow a spinning apparatus (not shown) to spin insert 20, 22 and apply pressure to mixing chamber 12 causing the material of mixing chamber 12 and insert 20, 22 to melt from the friction of the pressure and spinning motion. After a predetermined amount of pressure and spinning at a predetermined speed, insert 20, 22 is stopped in a preferred rotational position relative to mixing chamber 12 and the heat from the process dissipates and the contacting material of insert 20, 22 and mixing chamber 12 are fused to form a waterproof connection.

Figure 4:
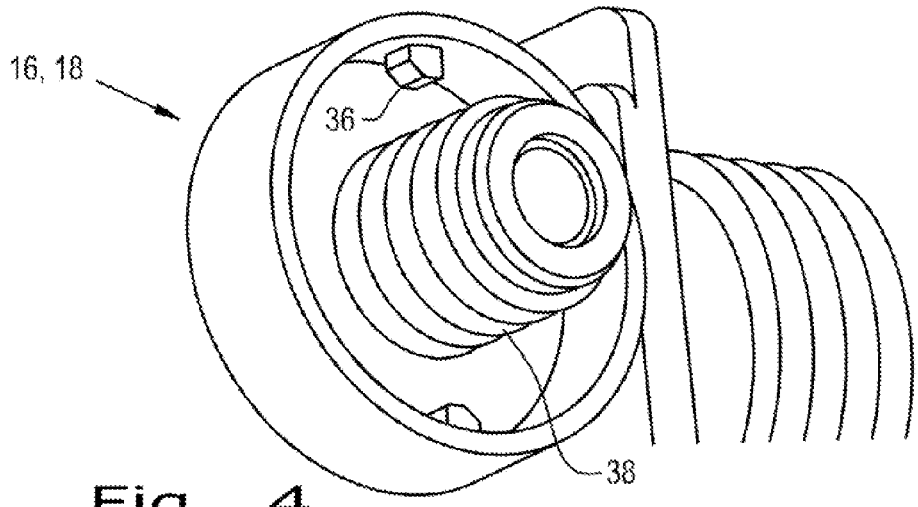
FIG. 4 is a perspective view of one embodiment of a valve assembly used with the water inlet system of FIGS. 1-3.

As can be seen in FIG. 3 insert 20, 22 has a locking attribute 30. Locking attribute 30 interacts with a locking protrusion or tab 36 (FIG. 4) of valves 16, 18. Locking attribute 30 may be a resilient finger that is only attached to insert 20, 22 along the left portion of locking attribute 30 as seen in FIG. 3. Alternatively, locking attribute 30 can be attached along the walls to form an inclined ramp of a higher resiliency. There is a cavity below locking attribute 30 to allow for movement and/or deformation of locking attribute 30 as tab 36 moves along the surface thereof. Tab 36 initially moves in a longitudinal direction 32, then is rotated in direction 34. As tab 36 passes the end of locking attribute 30, locking attribute 30 springs up to preclude the removal of valve 16, 18 therefrom. Although inserts 20 and 22 can be identical, it is also contemplated that inserts 20 and 22 may be minor images of each other and that the interfacing portions of valves 16 and 18 may likewise be minor images to thereby ensure that the proper valve is connected to the proper insert. Other keying regimes are also contemplated.

Valve assemblies 16 and 18 are respectively positioned so as to move in a longitudinal direction 26 relative to inserts 20, 22 and valves 16 and 18 are respectively secured to inserts 20 and 22. Now, additionally referring to FIG. 4 details can be seen as to how valve assemblies 16 and 18 lock to inserts 20 and 22 and thereby to mixing chamber 12. Valve assemblies 16 and 18 each have locking tabs 36 and seals 38. A male portion of valve assembly 16, 18 with seal 38 thereabout enter into a corresponding opening in insert 20, 22. As valve assembly 16, 18 is inserted into insert 20, 22 locking tab 36 moves in direction 32, then is moved in direction 34 until locking tab 36 is positioned in locking attribute 30 thereby precluding the removal of valve assembly 16, 18 from insert 20, 22. Locking attribute 30 is positioned and shaped to interact with a back edge of locking tab 36 to preclude removal. A forward edge of locking tab 36 is beveled to allow a rotational movement of valve assembly 16, 18, the shape may also cause the material around locking tab 36 to flex as it is rotated into position in direction 34. The angular amount of rotation may be approximately 45° . While locking attribute 30 and locking tab 36 serve to preclude removal, it is also contemplated that these elements can also be arranged so that valve assembly 16, 18 can be removed from mixing chamber 12.

Figure 5:
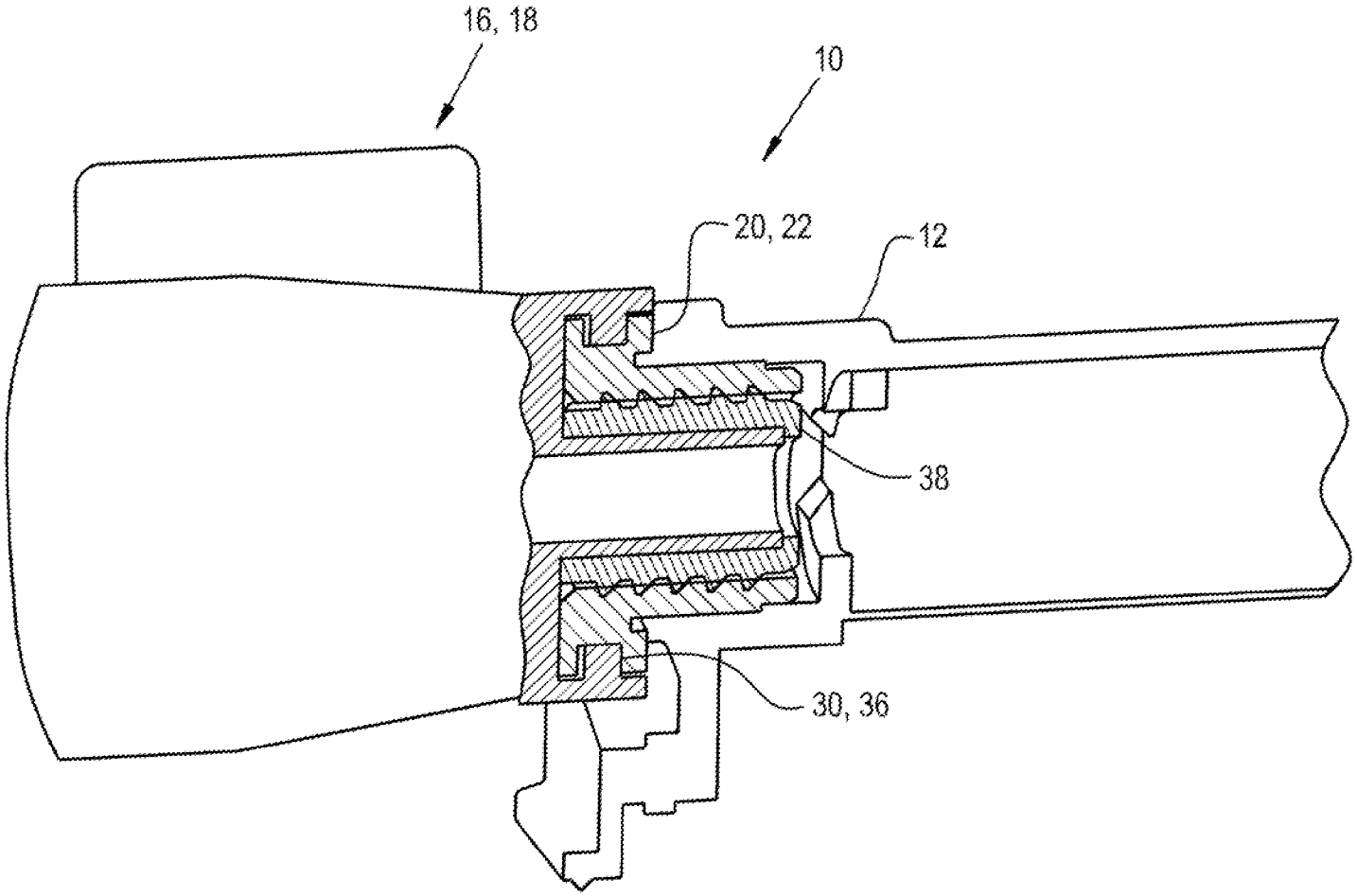
FIG. 5 is a partially sectioned side view of the water inlet system of FIGS. 1-4.

Now, additionally referring to FIG. 5, a partially sectioned view is shown as to how valve assembly 16, 18 is connected to insert 20, 22 allowing the fluidic connection between valve assembly 16, 18 with mixing chamber 12. Seal 38 may have elements, such as annular features that correspond to reciprocal features to thereby ensure a leak-proof connection.

Figure 6:
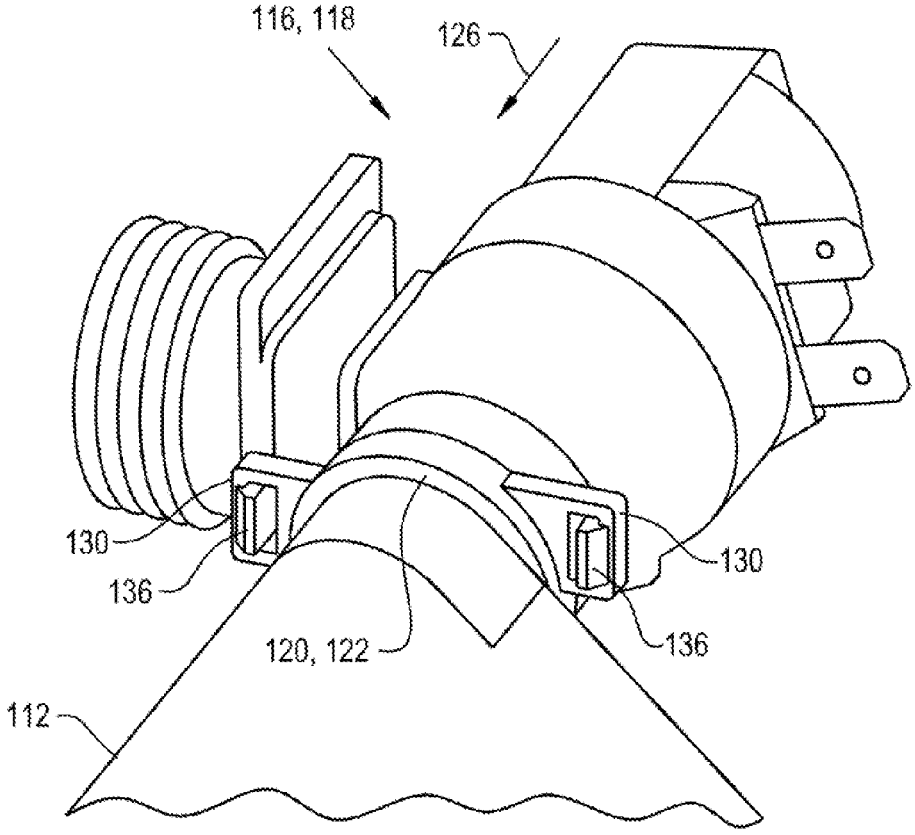
FIG. 6 is a perspective view of another valve assembly assembled with another embodiment of the insert of the water inlet system of FIG. 1.

Now, additionally referring to FIG. 6, there is illustrated another embodiment of a valve assembly, here denoted as 116, 118, having a snap feature 136. Inserts 120, 122 are connected to main body 112, and inserts 120, 122 have locking features 130 oriented relative to mixing chamber 112. In this embodiment valve assembly 116, 118 is pressed into mixing chamber 112 in a longitudinal direction 126, and snap features 136 are aligned with locking features 130 to ensure the proper positioning and securing of the two together.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A water inlet system for a washing machine, comprising:
a main body made of a first material;
at least one insert spin welded to said main body, said at least one insert being made of a material substantially the same as said first material, said insert including:
at least one locking attribute, wherein said at least one locking attribute is a flexible member; and
a valve assembly mechanically coupled and sealed with said insert, said valve assembly having a valve body made of a second material, said first material and said second material being different, said valve assembly including:
at least one locking protrusion that interacts with said at least one locking attribute to thereby secure said valve assembly to said at least one insert.

2. A water inlet system for a washing machine, comprising:
a main body made of a first material;
at least one insert spin welded to said main body, said at least one insert being made of a material substantially the same as said first material; and
a valve assembly mechanically coupled and sealed with said insert, said valve assembly having a valve body made of a second material, said first material and said second material being different, wherein said at least one insert is a plurality of inserts including a first insert and a second insert, both said first insert and said second insert being spin welded to said main body.

3. The water inlet system of claim 2, wherein said first insert and said second insert face substantially opposite directions.

4. The water inlet system of claim 3, further comprising an other valve assembly, said first insert being configured to connect with said valve assembly but not with said other valve assembly.

5. The water inlet system of claim 4, wherein said second insert is configured to connect with said other valve assembly but not with said valve assembly.

6. The water inlet system of claim 5, wherein said first insert is configured to lockingly mate with said valve assembly with a rotational twist in a first rotational direction, said second insert being configured to lockingly mate with said other valve assembly with a rotational twist in a second rotational direction, said first rotational direction being opposite said second rotational direction.

7. The water inlet system of claim 5, wherein said first insert is configured to lockingly mate with said valve assembly in a first longitudinal direction, said second insert being configured to lockingly mate with said other valve assembly in a second longitudinal direction, said first longitudinal direction being opposite said second longitudinal direction.

8. An insert system for use with a water inlet system of a washing machine, the water inlet system having a main body made of a first material and a valve assembly made of a second material, the insert system comprising:

at least one insert spin welded to the main body, said at least one insert being made of a material substantially the same as the first material, said insert includes at least one locking attribute, wherein said at least one locking attribute is a flexible member, the valve assembly being mechanically couplable and sealable to said insert, wherein the valve assembly includes at least one locking protrusion that interacts with said at least one locking attribute to thereby secure the valve assembly to said at least one insert, said first material and said second material being different.

9. An insert system for use with a water inlet system of a washing machine, the water inlet system having a main body made of a first material and a valve assembly made of a second material, the insert system comprising:

at least one insert spin welded to the main body, said at least one insert being made of a material substantially the same as the first material, the valve assembly being mechanically couplable and sealable to said insert, said first material and said second material being different, wherein said at least one insert is a plurality of inserts including a first insert and a second insert, both said first insert and said second insert being spin welded to the main body.

10. The insert system of claim 9, wherein said first insert and said second insert face substantially opposite directions.

11. The insert system of claim 10, wherein the water inlet system further includes an other valve assembly, said first insert being configured to connect with the valve assembly but not with the other valve assembly.

12. The insert system of claim 11, wherein said second insert is configured to connect with the other valve assembly but not with the valve assembly.

13. The insert system of claim 12, wherein said first insert is configured to lockingly mate with the valve assembly with a rotational twist in a first rotational direction, said second insert being configured to lockingly mate with the other valve assembly with a rotational twist in a second rotational direction, said first rotational direction being opposite said second rotational direction.

14. The insert system of claim 12, wherein said first insert is configured to lockingly mate with the valve assembly in a first longitudinal direction, said second insert being configured to lockingly mate with the other valve assembly in a second longitudinal direction, said first longitudinal direction being opposite said second longitudinal direction.

* * * * *